US009962974B2

(12) United States Patent
Seki et al.

(10) Patent No.: US 9,962,974 B2
(45) Date of Patent: May 8, 2018

(54) INKJET PRINTING APPARATUS AND INKJET PRINTING METHOD

(71) Applicant: MIMAKI ENGINEERING CO., LTD., Nagano (JP)

(72) Inventors: Akifumi Seki, Nagano (JP); Masaru Ohnishi, Nagano (JP); Kazuya Nozaki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days. days.

(21) Appl. No.: 15/124,674

(22) PCT Filed: Feb. 20, 2015

(86) PCT No.: PCT/JP2015/054751
§ 371 (c)(1),
(2) Date: Sep. 8, 2016

(87) PCT Pub. No.: WO2015/137087
PCT Pub. Date: Sep. 17, 2015

(65) Prior Publication Data

US 2017/0015122 A1 Jan. 19, 2017

(30) Foreign Application Priority Data

Mar. 10, 2014 (JP) ..... 2014-046913

(51) Int. Cl.
*B41J 29/377* (2006.01)
*B41J 11/00* (2006.01)
(Continued)

(52) U.S. Cl.
CPC ..... *B41J 29/377* (2013.01); *B41J 2/01* (2013.01); *B41J 11/002* (2013.01); *B41J 15/16* (2013.01)

(58) Field of Classification Search
CPC . B41J 29/377; B41J 2/01; B41J 11/002; B41J 15/16
See application file for complete search history.

(56) References Cited

U.S. PATENT DOCUMENTS

2011/0090279 A1* 4/2011 Yanagi ..... B41M 5/0017 347/21
2012/0162304 A1 6/2012 Fujikura

FOREIGN PATENT DOCUMENTS

JP 2012-030534 2/2012
JP 2012-135984 7/2012
JP 2013-193222 9/2013

OTHER PUBLICATIONS

"Search Report of Europe Counterpart Application", dated Apr. 10, 2017, p. 1-p. 8.

(Continued)

*Primary Examiner* — Geoffrey Mruk
(74) *Attorney, Agent, or Firm* — JCIPRNET

(57) ABSTRACT

This disclosure is directed to more effectively prevent blocking. An inkjet printing apparatus 100 has a platen 3, an after-heater 4, a take-up gear 5, and a cooler. The platen 3 heats a medium 20 to a temperature lower than or equal to a glass-transition temperature $Tg_1$ of a resin included in the medium 20. The after-heater 4 heats the medium 20 to a temperature higher than or equal to a glass-transition temperature $Tg_2$ of a resin contained in the ink. The take-up gear 5 collects the printed medium 20. The medium 20 or the take-up gear 5 is cooled by the cooler so as to reach a temperature lower than both the temperature $Tg_1$ and the temperature $Tg_2$.

7 Claims, 2 Drawing Sheets

(51) Int. Cl.
*B41J 15/16* (2006.01)
*B41J 2/01* (2006.01)

(56) References Cited

OTHER PUBLICATIONS

Hosoda Toryo Kabushiki Kaisha, "Mimaki JV400-130LX/160LX New Release!" Feb. 28, 2012, available at: http://sign.hosodapaint.com/e49211.html, retrieved on Oct. 13, 2016, with English translation thereof.
"International Search Report (Form PCT/ISA/210)", dated Mar. 17, 2015, with English translation thereof, pp. 1-4.
"Office Action of Europe Counterpart Application," dated Jan. 2, 2018, p. 1-p. 4.

* cited by examiner

INKJET PRINTING APPARATUS AND INKJET PRINTING METHOD

CROSS-REFERENCE TO RELATED APPLICATION

This application is a 371 application of the International PCT application serial no. PCT/JP2015/054751, filed on Feb. 20, 2015, which claims the priority benefits of Japan Patent Application No. 2014-046913, filed on Mar. 10, 2014. The entirety of each of the above-mentioned patent applications is hereby incorporated by reference herein and made a part of this specification.

TECHNICAL FIELD

This disclosure relates to an inkjet printing apparatus and an inkjet printing method.

BACKGROUND ART

Conventionally, inkjet printing apparatuses print a print object on a recording medium by discharging an ink on the recording medium and vaporizing a solvent contained in the ink discharged on the recording medium. The printing-completed recording medium is then wound around and collected by a take-up gear. In such conventional inkjet printing apparatuses, the ink discharged on the recording medium is heated by a platen to vaporize the solvent in the ink. When the recording medium is wound around the take-up gear, the heated ink between layers of the wound medium may bleed through from one layer to another. This event is conventionally termed as blocking.

Patent Literature 1 describes technical means devised with an aim to prevent the occurrence of blocking. Specifically, Patent Literature 1 describes an image forming apparatus where each recording medium on which printing has been performed is serially discharged and stacked in layers in a discharge unit. This apparatus has a cooling device for cooling the recording medium that is before being piled up in the discharge unit.

With this configuration, the recording medium is cooled by the cooling device and then piled up in the discharge unit. As the recording medium heated by the platen is cooled by the cooling device before being piled up in the discharge unit, the temperature of the ink on the recording medium drops, suppressing the occurrence of blocking between layers of the recording medium stacked in the discharge unit.

CITATION LIST

Patent Literature

Patent Literature 1: Japanese Unexamined Patent Publication No. 2012-135984

SUMMARY OF INVENTION

Technical Problems

Conventionally, inkjet printing apparatuses performing high-speed printing has an after-hearing unit between the platen and the take-up gear on the downstream side of the platen in a direction in which the recording medium is transported. The after-heater heats the ink on the recording medium to vaporize any residual solvent left unvaporized in the ink heated by the platen, thereby more efficiently vaporizing the solvent.

Unless the recording medium is sufficiently cooled down, however, the after-heater may be a factor that incurs the event of blocking between layers of the recording medium collected by the take-up gear. The take-up gear located close to the after-heater may be thereby thermally affected and elevated to higher temperatures, in which case the heat of the take-up gear may result in the occurrence of blocking. Patent Literature 1, however, is silent about how to cool the recording medium in the image forming apparatus equipped with such an after-heater. Thus, the cooling method described in Patent Literature 1 presents no effective means that can prevent the occurrence of blocking in inkjet printing apparatuses equipped with an after-heater. This cooling method may further need some improvements.

To address this issue, this disclosure is directed to providing an inkjet printing apparatus and an inkjet printing method that may more effectively prevent the occurrence of blocking.

Solutions to the Problems

In order to solve the problems, an aspect of this disclosure provides an inkjet printing apparatus, including: an ink jet head that discharges an ink on a recording medium; a platen that heats the recording medium after the ink is discharged on the recording medium to dry the ink, the recording medium being heated to a temperature lower than or equal to a glass-transition temperature $Tg_1$ of a resin included in the recording medium; an after-heater that heats the recording medium to further dry the ink on the recording medium dried by the platen, the recording medium being heated to a temperature higher than or equal to a glass-transition temperature $Tg_2$ of a resin contained in the ink; a take-up gear that collects the recording medium after the ink thereon is dried by the after-heater; and a cooler that cools at least one of the recording medium and the take-up gear. At least one of the take-up gear and the recording medium after the ink thereon is dried by the after-heater is cooled by the cooler so as to reach a predetermined temperature lower than both the glass-transition temperature $Tg_1$ and the glass-transition temperature $Tg_2$.

In order to solve the problems, an aspect of this disclosure provides an inkjet printing method, including: a printing step of discharging an ink on a recording medium; a first heating step of heating the recording medium after the ink is discharged on the recording medium to dry the ink, the recording medium being heated to a temperature lower than or equal to a glass-transition temperature $Tg_1$ of a resin included in the recording medium; a second heating step of heating the recording medium to further dry the ink on the recording medium dried in the first heating step, the recording medium being heated to a temperature higher than or equal to a glass-transition temperature $Tg_2$ of a resin contained in the ink; a take-up step of collecting the recording medium after the ink thereon is dried in the second heating step using a take-up gear; and a cooling step of cooling at least one of the recording medium and the take-up gear. In the cooling step preceding the take-up step, at least one of the take-up gear and the recording medium after the ink thereon is dried in the second heating step is cooled so as to reach a predetermined temperature lower than both the glass-transition temperature $Tg_1$ and the glass-transition temperature $Tg_2$.

With this configuration, when the recording medium is chosen to be cooled, the recording medium is cooled and then collected by the take-up gear. This may effectively suppress the occurrence of blocking. When the take-up gear is chosen to be cooled, the take-up gear may be prevented from reaching high temperatures under the heat of the after-heater. This may suppress the risk of blocking due to the heat of the take-up gear.

In the inkjet printing apparatus according to the aspect, the cooler may be a transport path on which the recording medium is transported from the after-heater to the take-up gear. The recording medium may be self-cooled down to the predetermined temperature while being transported on the transport path.

With this configuration, while the recording medium is being transported on the transport path extending in a predetermined distance, the recording medium may be self-cooled down to temperatures at which the occurrence of blocking may be avoidable. The cooled recording medium is then collected by the take-up gear. The take-up gear is remotely spaced from the after-heater. The take-up gear, therefore, may be unlikely to reach high temperatures under the heat of the after-heater. Therefore, the resin contained in the ink on the recording medium may be adequately cooled, and the take-up gear may be unlikely to reach high temperatures. The likelihood of blocking may accordingly be suppressed.

In the inkjet printing apparatus according to the aspect, a distance L of the transport path may preferably satisfy the following formula, where Tc is a cooling time for the glass transfusion temperature $Tg_2$ to drop to the predetermined temperature, and Vm is a take-up speed of the take-up gear.

$$L \geq Vm \times Tc$$

With this configuration, while the recording medium is being transported, the recording medium may be adequately self-cooled down to the predetermined temperature.

In the inkjet printing apparatus according to the aspect, the cooler may be a heat radiation member disposed on the transport path on which the recording medium is transported from the after-heater to the take-up gear.

With this configuration, while the recording medium is being transported on the transport path having the heat radiation member disposed thereon, the recording medium may be cooled down to temperatures at which the occurrence of blocking may be avoidable. The cooled recording medium is then collected by the take-up gear. By thus allowing the resin contained in the ink on the recording medium to be adequately cooled, the likelihood of blocking may accordingly be suppressed.

In the inkjet printing apparatus according to the aspect, the heat radiation member may preferably be made of aluminum.

With this configuration, sufficient heat radiation is performed, and the heat of the recording medium may be effectively radiated.

In the inkjet printing apparatus according to the aspect, the cooler may be an air blower that blows cold air toward the take-up gear.

With this configuration, blowing cold air from the air blower toward the take-up gear may drop the temperature of the take-up gear to the predetermined temperature. This may prevent that the heat of the take-up gear triggers the occurrence of blocking in the recording medium collected by the take-up gear.

In the inkjet printing apparatus according to the aspect, the predetermined temperature may preferably be lower than or equal to 50° C.

With this configuration, the risk of blocking may be almost certainly eliminated.

In the inkjet printing method according to the aspect, the ink may preferably be at least one of an ink containing a solvent exclusive of water, and an ink containing a resin and water or an organic solvent in which the resin is emulsified or suspended in the organic solvent or water.

The ink thus defined is suitably applicable to the inkjet printing method according to the aspect.

Effect of the Invention

According to the aspect of this disclosure described so far, the occurrence of blocking resulting from the heat of the take-up gear may be effectively prevented by cooling the recording medium and/or the take-up gear.

DESCRIPTION OF EMBODIMENTS

First Embodiment

[Inkjet Printing Apparatus 100]

Figure 1:
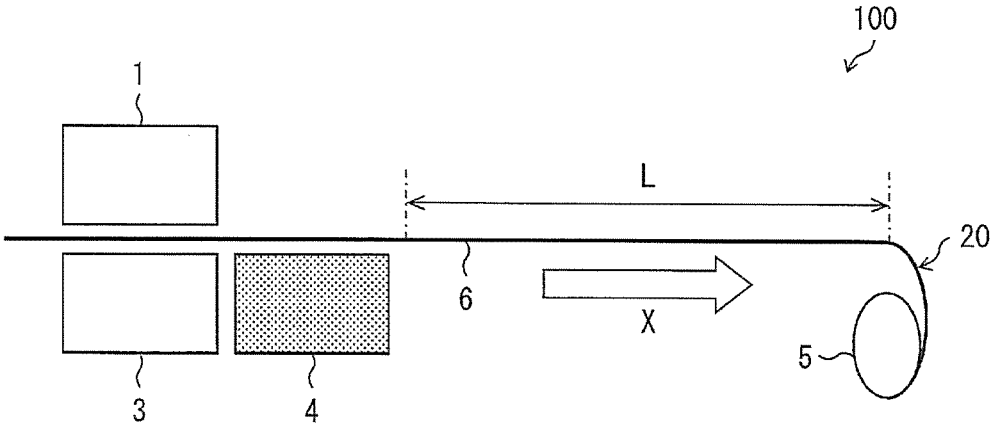
FIG. 1 is a schematic drawing of an inkjet printing apparatus according to an embodiment of this disclosure.
Figure 2:
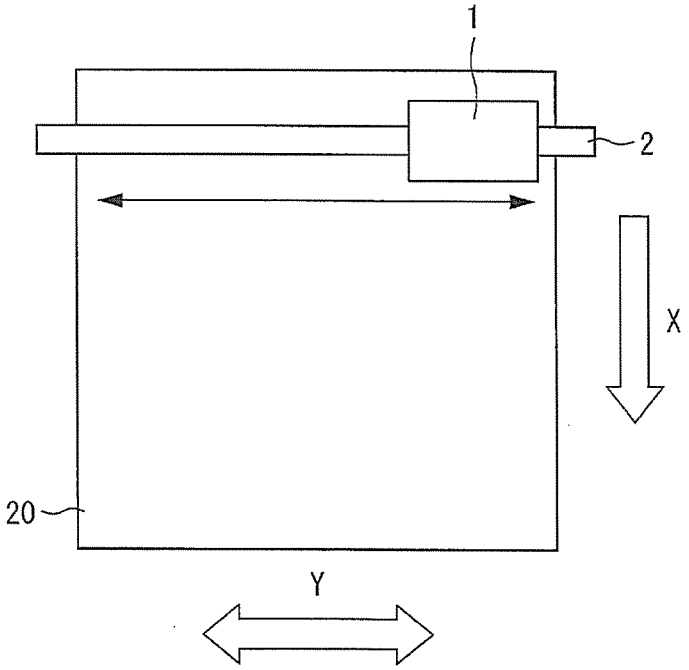
FIG. 2 is a schematic drawing of an ink jet head according to the embodiment.

A first embodiment of this disclosure is hereinafter described in detail referring to FIGS. 1 and 2. FIG. 1 is a schematic drawing of an inkjet printing apparatus 100 according to this embodiment. FIG. 2 is a schematic drawing of an ink jet head 1.

As illustrated in FIG. 1, the inkjet printing apparatus 100 of this embodiment has a transport unit that transports a medium (recording medium) 20, an ink jet head 1 that discharges an ink on the medium 20 to perform printing, a platen 3 that heats the medium 20, an after-heater 4 that heats the ink discharged on the medium 20, and a take-up gear 5 (a take-up means) that collects the medium 20. The platen 3 is disposed facing, across the medium 20, a region where the ink is discharged from the ink jet head 1. The after-heater 4 is disposed on the downstream side of the platen 3 in a direction in which the medium 20 is transported (direction illustrated with an arrow X in FIG. 1). The take-up gear 5 is disposed on the downstream side of the after-heater 4 in the transport direction of the medium 20.

The inkjet printing apparatus 100 performs printing on the medium 20 while changing relative positions of the ink jet head 1 and the medium 20. Examples of the inkjet printing apparatus 100 disclosed herein may include an inkjet printing apparatus using a serial head, and an inkjet printing apparatus using a line head. The former inkjet printing apparatus discharges an ink on the medium 20 from the ink jet head 1 while moving the ink jet head 1 in a direction intersecting the transport direction of the medium 20. The latter inkjet printing apparatus has a relatively long ink jet head 1. The printing apparatus of this type discharges an ink on the medium 20 from the ink jet head 1 fixed at a certain position while transporting the medium 20 alone.

[Transport Unit]

The transport unit is for transport of the medium 20 and disposed in vicinity of a position at which printing is performed on the medium 20 on the upstream or downstream side in the transport direction. The medium 20 can be transported by driving the transport unit. The transport unit may include, for example, rollers for feeding the medium 20. For feeding the medium 20, the medium 20, for example, may be held between two rollers and rotated with a certain level of pressure being applied thereto.

[Ink Jet Head 1]

The ink jet head 1 discharges an ink on the medium 20. While the ink jet head 1 is performing a scan in a scanning direction Y (lateral direction on the drawing of FIG. 2) along a guiding mechanism 2, the medium 20 is transported by the transport unit (not illustrated), in the transport direction X (vertical direction on the drawing of FIG. 2) orthogonal to the scanning direction Y. Then, a desired image is rendered on the medium 20 with the ink discharged from the ink jet head 1.

[Ink]

The color of the ink discharged from the ink jet head 1 may include but is not limited to any one of various colors: for example, the conventional colors including cyan, magenta, yellow, and black, or other specific colors including orange, green, white, metallic, and clear.

The ink used in the inkjet printing apparatus 100 contains a resin in addition to a solvent and a coloring agent that produces any one of the before-mentioned colors. Examples of the resin may include various types of fixing resins for an improved fixability of the ink to the medium 20. Examples of the fixing resins may include vinyl chloride/vinyl acetate resins, and polyester resins. Example of the vinyl chloride/vinyl acetate resins usable in this embodiment may include vinyl chloride/vinyl acetate copolymers, vinyl chloride/vinyl acetate/maleic acid copolymers, vinyl chloride/vinyl acetate/vinyl alcohol copolymers, and mixtures of any of these examples. Examples of the polyester resins usable in this embodiment may include crystalline and amorphous polyester resins. The ink used in the inkjet printing apparatus 100 may contain any suitable fixing resin other than the vinyl chloride/vinyl acetate resins and polyester resins.

Specific examples of the ink used in the inkjet printing apparatus 100 may include solvent inks and latex inks. The solvent ink refers to an ink containing a solvent, exclusive of water. Examples of the solvents contained in the solvent inks may include glycol ethers and glycol ether acetates, examples of which may be propylene glycol monomethyl ether, ethylene glycol monomethyl ether acetate, ethylene glycol monoethyl ether acetate, ethylene glycol monobutyl ether acetate, diethylene glycol monomethyl ether acetate, diethylene glycol monoethyl ether acetate, diethylene glycol monobutyl ether acetate, propylene glycol monomethyl ether acetate, dipropylene glycol monomethyl ether acetate, ethylene glycol monomethyl ether propionate, ethylene glycol monoethyl ether propionate, ethylene glycol monobutyl ether propionate, diethylene glycol monomethyl ether propionate, diethylene glycol monoethyl ether propionate, diethylene glycol monobutyl ether propionate, propylene glycol monomethyl ether propionate, dipropylene glycol monomethyl ether propionate, ethylene glycol monomethyl ether butyrate, ethylene glycol monoethyl ether butyrate, ethylene glycol monobutyl ether butyrate, diethylene glycol monomethyl ether butyrate, diethylene glycol monoethyl ether butyrate, diethylene glycol monobutyl ether butyrate, propylene glycol monomethyl ether butyrate, and dipropylene glycol monomethyl ether butyrate.

The solvent may be a hydrocarbon-based solvent. Examples of the hydrocarbon-based solvent may include n-hexane, n-heptane, n-octane, isooctane, cyclohexane, methyl cyclohexane, benzene, toluene, o-xylene, m-xylene, p-xylene, and ethylbenzene.

The solvent may be an ester-based solvent. Examples of the ester-based solvent may include propyl formate, formic acid-n-butyl, isobutyl formate, amyl formate, ethyl acetate, acetic acid-n-propyl, isopropyl acetate, acetic acid-n-butyl, isobutyl acetate, secondary butyl acetate, acetic acid-n-amyl isoamyl acetate, methyl isoamyl acetate, secondary hexyl acetate, methyl propionate, ethyl propionate, propionic acid-n-butyl, methyl butyrate, ethyl butyrate, methyl lactate, and γ-butyrolactone.

The solvent may be a ketone-based solvent. Examples of the ketone-based solvent may include methyl ethyl ketone, methyl-n-propyl ketone, methyl-n-butyl ketone, methyl isobutyl ketone, diethyl ketone, ethyl-n-butyl ketone, di-n-propyl ketone, and mesityl oxide.

The latex ink refers to an ink further containing a resin and an organic solvent or water in which the resin is emulsified or suspended in the organic solvent or water. An aqueous latex ink in which the resin is emulsified or suspended in water, if stated differently, has an aqueous emulsion or an aqueous suspension formed in the presence of the resin. The "resin" of the "ink containing a resin" used in the inkjet printing apparatus and the inkjet printing method disclosed herein may refer to a resin used to form an emulsion in the latex ink, or one of the fixing resins further added to the ink.

Examples of the resin may include water-soluble vinyl resins, acrylic resins, alkyd resins, polyester resins, polyurethane resins, silicon resins, fluororesins, epoxy resins, phenoxy resins, polyolefin resins, and modified resins of these examples. Of the mentioned examples, acrylic resins, water-soluble polyurethane resins, water-soluble polyester resins, and water-soluble acrylic resins are preferably used, and acrylic resins are particularly preferable. Among these exemplified resins to be contained in the aqueous latex ink, any one of them may be singly used, or two or more of them may be optionally combined. The resin content may be optionally decided depending on the type of a resin decided to be used. For example, the resin content may be greater than or equal to 1% by weight, and preferably be greater than or equal to 2% by weight of the whole aqueous latex ink. The resin content may be less than or equal to 20% by mass, and preferably be less than or equal to 10% by mass of the whole aqueous latex ink.

The latex ink is curable by drying or by heating. In case the latex ink is used for overcoat, an image formed with any kind of ink may be protected from possible damage. When the latex ink is used in the inkjet printing apparatus 100, therefore, there should be more time available for smoothing, and a printed matter having a smoother surface may be obtained. The latex ink may be usable with various types of the medium 20.

The latex ink may further contain an emulsifier for emulsifying or suspending the resin. The organic solvent or water contained in the latex ink may further contain another resin dissolved in the organic solvent or water in addition to the emulsified or suspended resin. The another resin may be dissolved in the organic solvent or water to adjust the viscosity of the ink. When the solvent is vaporized by drying the ink, particles of the emulsified or suspended resin bind to one another, forming a coating layer. In this process, the another resin may serve as a binding agent that enhances the binding strength between the particles of the emulsified or suspended resin.

[Platen 3]

The platen 3 is disposed at a position facing, across the medium 20, a region where the ink is discharged from the ink jet head 1. This platen heats the medium 20 until its temperature reaches a degree lower than or equal to a glass-transition temperature $Tg_1$ of the resin included in the medium 20. By using the platen 3, the ink discharged on the medium 20 can be dried (heated).

The platen 3 may heat the ink on the medium 20 at temperatures higher than or equal to 30° C. and lower than or equal to 90° C. The platen 3 may preferably heat the ink on the medium 20 at temperatures higher than or equal to 40° C. and lower than or equal to 70° C. Heating the ink at temperatures higher than or equal to 40° C. may vaporize the ink solvent and thereby increase the ink viscosity in a short period of time. In addition, heating the ink at temperatures lower than or equal to 70° C. may suppress the occurrence of cockling with recording media made of, for example, vinyl chloride inferior in heat resistance.

This inkjet printing apparatus may be further equipped with a pre-heater for heating the medium 20. The pre-heater may be disposed on the upstream side of the platen 3 in the transport direction of the medium 20. By preheating the medium 20 using this pre-heater, the solvent in the ink discharged on the medium 20 may be more efficiently vaporized. In case the medium 20 is a recording medium inferior in heat resistance, the platen 3 at high temperatures may lead to the occurrence of cockling. Preheating the medium 20 using the pre-heater may eliminate the need for high temperatures of the platen 3, favorably suppressing the occurrence of cockling.

[After-Heater 4]

The after-heater 4 is disposed on the downstream side of the platen 3 in the transport direction of the medium 20 to heat the ink on the medium 20. The after-heater 4 heats the ink on the medium 20 to a temperature higher than or equal to a glass-transition temperature $Tg_2$ of the resin contained in the ink. Heating the ink on the medium 20 using the after-heater is aimed at volatilizing any residual solvent left unvolatilized in the ink heated by the platen 3. The glass-transition temperature refers to a range of temperatures at which sudden changes occur in a substance's coefficients associated with temperature, for example, coefficient of thermal expansion, electric conductivity, viscosity, and/or any other physical quantities, between when the substance is in a low-temperature glass condition and when the substance is in a high-temperature supercooled liquid condition.

[Take-Up Gear 5]

The take-up gear 5 is disposed on the downstream side of the after-heater 4 in the transport direction of the medium 20. The take-up gear 5 collects the printing-completed medium 20 by winding the medium 20 around its circumferential portion. The take-up gear 5 may be a take-up roller. By driving the take-up roller in conjunction with the transport unit, the medium 20 transported by the transport unit may be wound around the take-up gear 5 without any slack. In case the medium 20 is moved by the rotary power of the take-up gear 5, the take-up gear 5 may be defined as a component of the transport unit.

[Cooler]

The inkjet printing apparatus 100 according to this embodiment is further equipped with a cooler (a cooling means). The cooler cools the medium 20 or the take-up gear 5 down to a predetermined temperature or below by the time when the medium 20 heated by the after-heater 4 arrives at the take-up gear 5. The predetermined temperature refers to a temperature at which the occurrence of blocking may be avoidable. The predetermined temperature is lower than both of the glass-transition temperature $Tg_1$ and the glass-transition temperature $Tg_2$. The predetermined temperature may preferably be lower than or equal to 50° C., more preferably between 20° C. and 50° C., and even more preferably a normal temperature.

In this embodiment, the cooler is a transport path 6 extending in a predetermined distance on which the medium 20 is transported from the after-heater 4 to the take-up gear 5. The predetermined distance refers to a distance long enough to allow for self-cooling of the currently transported medium 20 down to the predetermined temperature or below. Specifically, the predetermined distance may have a length L satisfying the following formula:

$$L \geq Vm \times Tc$$

(where Tc is a cooling time for the glass-transition temperature of the resin contained in the ink to drop to the predetermined temperature or below, and Vm is a take-up speed of the take-up gear 5).

The cooling time Tc refers to a period of cooling time in an environment where the inkjet printing apparatus 100 is activated and used.

While the medium 20 is being transported on the transport path 6 extending in the predetermined distance, the medium 20 may be self-cooled down to the predetermined temperature at which the occurrence of blocking may be avoidable. The cooled medium 2 is then collected by the take-up gear 5. The take-up gear 5 is remotely spaced from the after-heater 4. The take-up gear 5, therefore, may be unlikely to reach high temperatures under the heat of the after-heater 4. Therefore, the resin contained in the ink on the medium 20 may be adequately cooled, and the take-up gear 5 may be prevented from reaching high temperatures. The likelihood of blocking may accordingly be suppressed. Even when high-speed printing is performed using the inkjet printing apparatus 100, the medium 20 and the take-up gear 5 are adequately cooled down, suppressing the occurrence of blocking.

Second Embodiment

Figure 3:
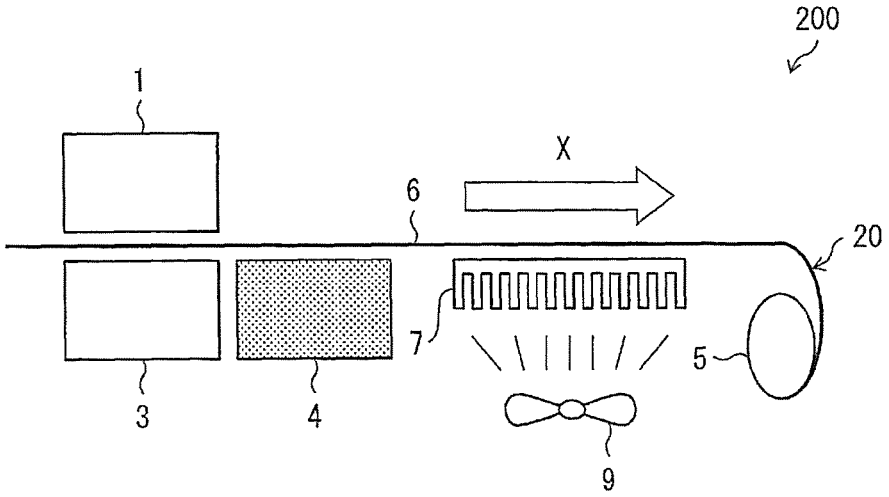
FIG. 3 is a schematic drawing of an inkjet printing apparatus according to an embodiment of this disclosure.

A second embodiment of this disclosure is hereinafter described in detail referring to FIG. 3. FIG. 3 is a schematic drawing of an inkjet printing apparatus 200 according to this embodiment. This embodiment, in order to expedite the description, illustrates any structural elements functionally similar to those described in the first embodiment with the same reference signs, and will skip the description of suchlike components.

As illustrated in FIG. 3, the inkjet printing apparatus 200 has a heat radiation member 7 serving as a cooler on a transport path 6. The heat radiation member 7 is disposed in contact with the back surface of the medium 20. The heat radiation member 7, by way of contact with the back surface of the medium 20, radiates the heat of the medium 20. In the heat radiation member 7, a surface not contacting the back surface of the medium 20 may preferably have a shape with a larger surface area. This may allow the heat radiation member 7 to fully exert its capacity to radiate heat. In FIG. 3, the heat radiation member 7 has irregularities on the surface not contacting the back surface of the medium 20, thereby increasing its surface area. Exemplified materials of the heat radiation member may include aluminum, brass, copper, and stainless steels. The predetermined distance defined in the first embodiment is not required of the transport path 6 in this embodiment.

This embodiment may optionally provide one heat radiation member 7 or a plurality of heat radiation members 7. How to arrange the heat radiation member 7 is not particularly limited. In order to increase efficiency of heat radiation, however, it may be suggested to provide an air blower 9 that blows cold air toward the heat radiation member 7. This may be an effective means for the heat radiation of the medium 20.

While the medium 20 is being transported on the transport path 6 having the heat radiation member 7 disposed thereon, the medium 20 may be cooled down to the predetermined temperature at which the occurrence of blocking may be avoidable. The cooled medium 20 is then collected by the take-up gear 5. Thus cooling the medium 20 may adequately cool the resin in the ink on the medium 20, suppressing the occurrence of blocking.

Third Embodiment

Figure 4:
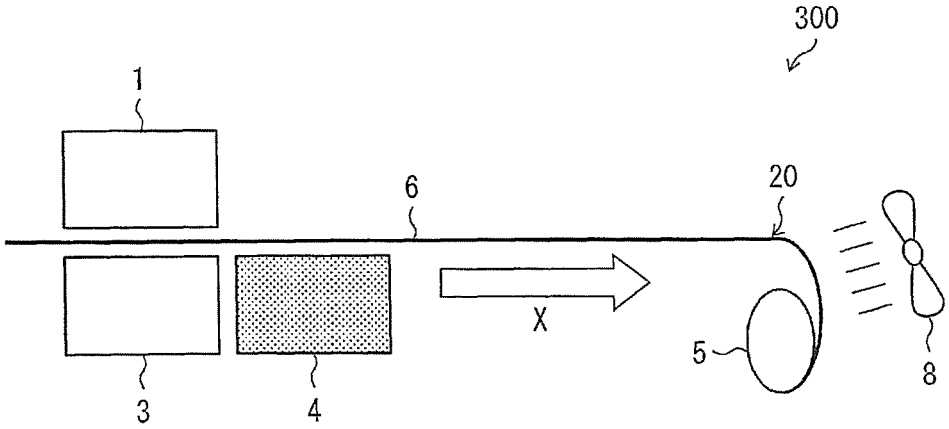
FIG. 4 is a schematic drawing of an inkjet printing apparatus according to an embodiment of this disclosure.

A third embodiment of this disclosure is hereinafter described in detail referring to FIG. 4. FIG. 4 is a schematic drawing of an inkjet printing apparatus 300 according to this embodiment. This embodiment, in order to expedite the description, illustrates any structural elements functionally similar to those described in the first embodiment with the same reference signs, and will skip the description of suchlike components.

As illustrated in FIG. 4, the inkjet printing apparatus 300 has an air blower 8 (air blow means) as the cooler. The air blower 8 blows cold air toward the take-up gear 5. An example of the air blower 8 may be a blast fan. The predetermined distance defined in the first embodiment is not required of the transport path 6 in this embodiment.

This embodiment may optionally provide one air blower 8 or a plurality of air blowers 8. How to arrange the air blower 8 may be optionally decided.

Thus blowing cold air from the air blower 8 toward the take-up gear 5 may drop the temperature of the take-up gear 5 to the predetermined temperature. This may prevent that the heat of the take-up gear 5 triggers the occurrence of blocking in the medium 20 collected by the take-up gear 5.

This disclosure is not necessarily limited to the embodiments described so far and may be carried out in many other forms. The technical scope of this disclosure encompasses any modifications within the technical scope disclosed herein that is defined by the appended claims and embodiments obtained by variously combining the technical means disclosed herein.

In the first embodiment, the medium 20 and the take-up gear 5 are both cooled down to the predetermined temperature or below. This is, however, a non-limiting example. For example, the medium 20 may be cooled down to the predetermined temperature or below as described in the second embodiment, or the take-up gear 5 may be cooled down to the predetermined temperature or below as described in the third embodiment. In the inkjet printing apparatus disclosed herein, the occurrence of blocking may certainly be prevented by cooling at least one of the medium 20 and the take-up gear 5 down to the predetermined temperature or below.

[Additional Remarks]

An aspect of this disclosure provides an inkjet printing apparatus 100, including: an ink jet head 1 that discharges an ink on a medium 20; a platen 3 that heats the medium 20 after the ink is discharged thereon to dry the ink, the medium 20 being heated to a temperature lower than or equal to a glass-transition temperature $Tg_1$ of a resin included in the medium 20; an after-heater 4 that heats the medium 20 to further dry the ink on the medium 20 dried by the platen 3, the medium 20 being heated to a temperature higher than or equal to a glass-transition temperature $Tg_2$ of a resin contained in the ink; a take-up gear 5 that collects the medium 20 after the ink thereon is dried by the after-heater 4; and a cooler that cools at least one of the medium 20 and the take-up gear 5. At least one of the take-up gear 5 and the medium 20 after the ink thereon is dried by the after-heater 4 is cooled by the cooler so as to reach a predetermined temperature lower than both the glass-transition temperature $Tg_1$ and the glass-transition temperature $Tg_2$.

In order to solve the problems described above, an aspect of this disclosure provides an inkjet printing method, including: a printing step of discharging an ink on a medium 20; a first heating step of heating the medium 20 after the ink is discharged thereon to dry the ink, the medium 20 being heated to a temperature lower than or equal to a glass-transition temperature $Tg_1$ of a resin included in the medium 20; a second heating step of heating the medium 20 to further dry the ink on the medium 20 dried in the first heating step, the medium 20 being heated to a temperature higher than or equal to a glass-transition temperature $Tg_2$ of a resin contained in the ink; a take-up step of collecting the medium 20 after the ink thereon is dried in the second heating step using a take-up gear 5; and a cooling step of cooling at least one of the medium 20 and the take-up gear 5. In the cooling step preceding the take-up step, at least one of the take-up gear 5 and the medium 20 after the ink thereon is dried in the second heating step is cooled so as to reach a predetermined temperature lower than both the glass-transition temperature $Tg_1$ and the glass-transition temperature $Tg_2$.

When the medium 20 is chosen to be cooled, the medium 20 is cooled and then collected by the take-up gear 5. This may effectively suppress the occurrence of blocking. When the take-up gear 5 is chosen to be cooled, the take-up gear 5 may be prevented from reaching high temperatures under the heat of the after-heater 4. This may suppress the risk of blocking due to the heat of the take-up gear 5.

In the inkjet printing apparatus 100 according to the aspect, the cooler may be a transport path 6 on which the medium 20 is transported from the after-heater 4 to the take-up gear 5. The medium 20 may be self-cooled down to the predetermined temperature while being transported on the transport path 6.

With this configuration, while the medium 20 is being transported on the transport path 6 extending in a predetermined distance, the medium 20 may be self-cooled down to temperatures at which the occurrence of blocking may be avoidable. The cooled medium 20 is then collected by the take-up gear 5. The take-up gear 5 is remotely spaced from the after-heater 4. The take-up gear 5, therefore, may be unlikely to reach high temperatures under the heat of the after-heater. Therefore, the resin contained in the ink on the medium 20 may be adequately cooled, and the take-up gear 5 may be prevented from reaching high temperatures. The likelihood of blocking may accordingly be suppressed.

In the inkjet printing apparatus 100 according to the aspect, a distance L of the transport path may preferably satisfy the following formula, where Tc is a cooling time for the glass transfusion temperature $Tg_2$ to drop to the predetermined temperature, and Vm is a take-up speed of the take-up gear.

$$L \geq Vm \times Tc$$

With this configuration, while the medium 20 is being transported, the medium 20 may be adequately self-cooled down to the predetermined temperature.

In the inkjet printing apparatus 200 according to an aspect of this disclosure, the cooler may be a heat radiation member 7 disposed on the transport path 6 on which the medium 20 is transported from the after-heater 4 to the take-up gear 5.

With this configuration, while the medium 20 is being transported on the transport path 6 having the heat radiation member 7 disposed thereon, the medium 20 may be cooled down to temperatures at which the occurrence of blocking may be avoidable. The cooled medium 20 is then collected by the take-up gear 5. Thus cooling the medium 20 may adequately cool the resin in the ink on the medium 20, suppressing the occurrence of blocking.

In the inkjet printing apparatus 200 according to the aspect, the heat radiation member 7 may preferably be made of aluminum.

With this configuration, sufficient heat radiation is performed, and the heat of the medium 20 may be effectively radiated.

In the inkjet printing apparatus 300 according to an aspect of this disclosure, the cooler may be an air blower 8 that blows cold air toward the take-up gear 5.

With this configuration, blowing cold air from the air blower 8 toward the take-up gear 5 may drop the temperature of the take-up gear 5 to the predetermined temperature. This may prevent that the heat of the take-up gear 5 triggers the occurrence of blocking in the medium 20 collected by the take-up gear 5.

In the inkjet printing apparatus 100 according to the aspect, the predetermined temperature may preferably be lower than or equal to 50° C.

With this configuration, the risk of blocking may be almost certainly eliminated.

In the inkjet printing method according to the aspect, the ink may preferably be at least one of an ink containing a solvent exclusive of water, and an ink containing a resin and water or an organic solvent in which the resin is emulsified or suspended in the organic solvent or water.

The ink thus defined is suitably applicable to the inkjet printing method according to the aspect.

EXAMPLE

A printing test was carried out with the inkjet printing apparatus 100 according to the first embodiment under the conventional printing conditions (resolution: 540×1080, number of passes: 12, printing direction: bidirectional (BL), high-speed printing mode (Hi), overprinting: twice (two layers), amount of discharged ink: 33 cc/m$^2$). In this test, the media 20 printed under the conditions were collected by the take-up gear 5 having different temperatures: 75° C., 60° C., and 50° C. The media 20 were then unfolded to visually check whether or not the blocking occurred. The result is shown in Table 1 in which ○ indicates the blocking-less medium, Δ indicates the blocking-mitigated medium, and x indicates the blocking-detected medium. The media 20 on the after-heater 4 was 50° C. immediately after the printing ended.

TABLE 1

| Temperature | 75° C. | 60° C. | 50° C. |
|---|---|---|---|
| Blocking detected or no blocking | x | Δ | ○ |

As shown in Table 1, the blocking evidently occurred when the take-up gear 5 had the temperature of 75° C., while the blocking, though more or less mitigated, was not completely prevented when the take-up gear 5 had the temperature of 60° C. On the other hand, a satisfactory printed surface that had escaped the blocking was obtained when the take-up gear 5 had the temperature of 50° C. This test result reveals that the temperature regulation of the take-up gear 5 to stay at 50° C. or below offers a favorable outcome in the pursuit of blocking control.

INDUSTRIAL APPLICABILITY

This disclosure is applicable to inkjet printing apparatuses and is particularly useful for high-speed inkjet printing apparatuses.

The invention claimed is:

1. An inkjet printing apparatus used for discharging an ink on a recording medium that includes a resin, comprising:

an ink jet head that discharges an ink on the recording medium;

a platen that heats the recording medium after the ink is discharged on the recording medium to dry the ink, the recording medium being heated to a temperature lower than or equal to a glass-transition temperature $Tg_1$ of the resin included in the recording medium;

an after-heater that heats the recording medium to further dry the ink on the recording medium dried by the platen, the recording medium being heated to a temperature higher than or equal to a glass-transition temperature $Tg_2$ of a resin contained in the ink;

a take-up gear that collects the recording medium after the ink on the recording medium is dried by the after-heater; and a cooler that cools at least one of the recording medium and the take-up gear, wherein the platen is disposed facing, across the recording medium, a region where the ink is discharged from the ink jet head, wherein at least one of a temperature of the recording medium after the ink on the recording medium and a temperature of the take-up gear is dried by being disposed on the after-heater is cooled by the cooler so as to reach a predetermined temperature lower than both the glass-transition temperature $Tg_1$ and the glass-transition temperature $Tg_2$.

2. The inkjet printing apparatus as set forth in claim 1, wherein the cooler is a transport path on which the recording medium is transported from the after-heater to the take-up gear, and the recording medium is self-cooled down to the predetermined temperature while being transported on the transport path.

3. The inkjet printing apparatus as set forth in claim 2, wherein a distance L of the transport path satisfies the formula, $L \geq Vm \times Tc$, where Tc is a cooling time for the glass-transition temperature $Tg_2$ to drop to the predetermined temperature, and Vm is a take-up speed of the take-up gear.

4. The inkjet printing apparatus as set forth in claim 1, wherein the cooler is a heat radiation member disposed on a transport path on which the recording medium is transported from the after-heater to the take-up gear.

5. The inkjet printing apparatus as set forth in claim 4, wherein the heat radiation member is made of aluminum.

6. The inkjet printing apparatus as set forth in claim 1, wherein the cooler is an air blower that blows cold air toward the take-up gear.

7. The inkjet printing apparatus as set forth in claim 1, wherein the predetermined temperature is lower than or equal to 50° C.

* * * * *